US005372564A

United States Patent [19]

Spirito

[11] Patent Number: 5,372,564

[45] Date of Patent: Dec. 13, 1994

[54] EXERCISE DEVICE FOR EXERCISING THE LEG ABDUCTOR, UPPER ARM AND POSTURAL MUSCLE GROUPS

[76] Inventor: Pamela J. Spirito, 203 Sycamore Ave., Apt. E-2, Merion, Pa. 19066

[21] Appl. No.: 56,867

[22] Filed: May 5, 1993

[51] Int. Cl.[5] ..... A63B 21/008

[52] U.S. Cl. ..... 482/112; 482/111; 482/142

[58] Field of Search ..... 482/111, 112, 142, 123, 482/126, 128, 129, 130, 117, 74, 85, 90; 273/26 R

[56] References Cited

U.S. PATENT DOCUMENTS

| | | | |
|---|---|---|---|
| 3,139,282 | 6/1964 | Lande | 273/26 R |
| 3,587,319 | 6/1971 | Andrews | 482/112 |
| 3,634,895 | 1/1972 | Childers | 482/74 |
| 4,227,689 | 10/1980 | Keiser . | |
| 4,257,593 | 3/1981 | Keiser . | |
| 4,478,411 | 10/1984 | Baldwin . | |
| 4,720,099 | 1/1988 | Carlson . | |
| 4,813,667 | 3/1989 | Watterson | 482/112 |
| 4,830,371 | 5/1989 | Lay | 273/26 R |
| 4,903,966 | 2/1990 | Liao | 482/90 |
| 5,013,034 | 5/1991 | March et al. | 482/117 |
| 5,108,093 | 4/1992 | Watterson | 482/112 |
| 5,176,601 | 1/1993 | Reynolds | 482/123 |
| 5,205,802 | 4/1993 | Swisher | 482/141 |

OTHER PUBLICATIONS

Precore ® 725e Low-Impact Climber Parts List.

*Primary Examiner*—Richard J. Apley
*Assistant Examiner*—Lynne A. Reichard
*Attorney, Agent, or Firm*—Eric A. LaMorte

[57] ABSTRACT

An exercise device that enables a person to exercise the abductor muscles of the legs, the postural muscles and the muscles of the upper arms. The exercise device includes a base structure and two elongated members, each having an upper end and a lower end, that are joined to the base structure. The lower end of each elongated member is pivotably coupled to the base structure in a manner that enables each of the elongated members to be pivotably moved about its lower end in a direction generally away from the other elongated member. The pivotable movement of each of the elongated members is resisted by the presence of at least one resistance element that extends between each elongated member and the base structure. The presence of the resistance elements biases each elongated member into a set position that is generally perpendicular to the horizontal surface of the base structure. As a result, each of the elongated members can be pivotably moved away from each other by applying a force to an elongated member that is greater than the resistance provided by the resistance element.

13 Claims, 4 Drawing Sheets

FIG-3
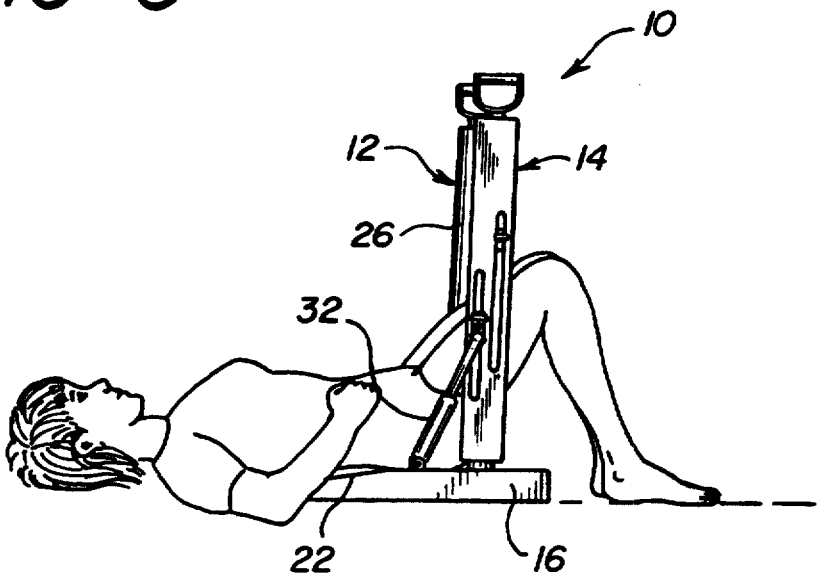
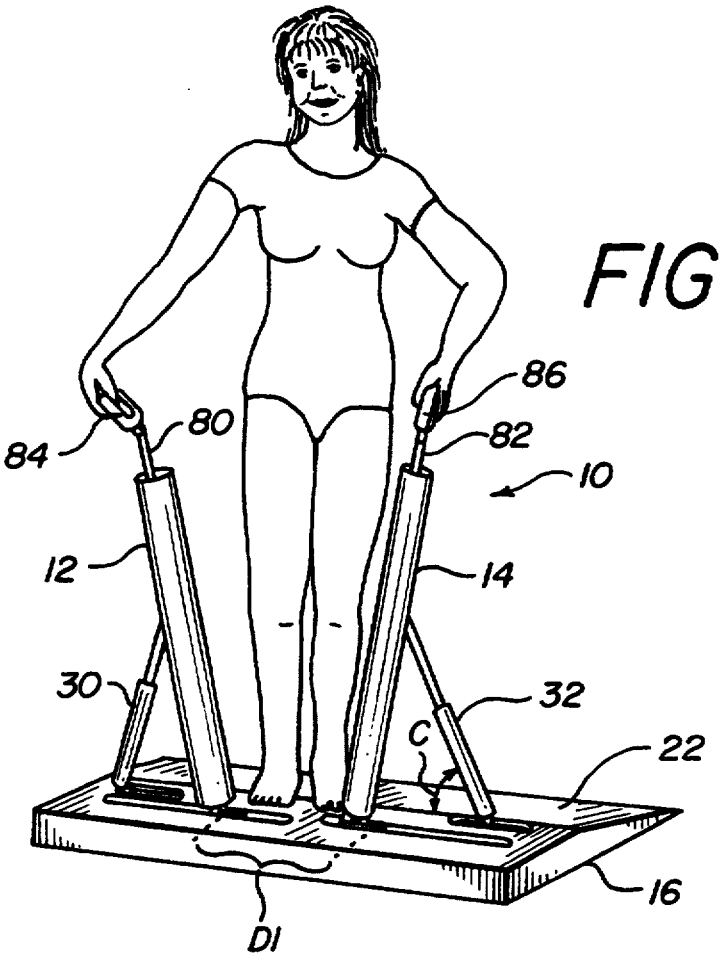
FIG-4

EXERCISE DEVICE FOR EXERCISING THE LEG ABDUCTOR, UPPER ARM AND POSTURAL MUSCLE GROUPS

BACKGROUND OF THE INVENTION

1. Field of the Invention

The present invention relates to exercise devices in general that utilize fixed resistance elements to provide a controlled resistance to the body's movements. More particularly, the present invention relates to exercise devices capable of exercising the leg abductor, upper arm and postural muscle groups of a person depending upon the orientation of the person with respect to the exercise device.

2. Prior Art Statement

In the fundamental sense, exercise is required for the good health of all people. For athletes, exercise that conditions the athlete's body for the sport in which he or she competes is required in order to excel at that sport. For body builders and those who want to improve the appearance of their bodies, exercise provides a means to build muscle mass and strength, reduce fat and otherwise tone desired muscle groups. Furthermore, exercise is also necessary in many types of rehabilitation programs for people recovering from illness, injury, surgery and the like. As a result of the multitude of people who utilize exercise devices and the variety of reasons for their use, the prior art is replete with prior art patents that address exercise devices for most every type of person and for most every major muscle group in the body.

Typically, exercise devices work by providing some type of resistance to the various body movements. By working a desired muscle group against the resistance of the exercise device, that muscle group can be conditioned. For instance, one of the simplest forms of exercise devices is the free weight. Free weights are typically gripped by a person's hands or attached to various parts of the body, such as the ankles or wrists, whereby the presence of the weights provides resistance to various movements of the body against the direction of gravity. Thus, by repeatedly making such movements, the muscle groups that move the free weights against gravity are conditioned.

Obviously not all muscle groups can be effectively conditioned by the use of free weights. For many muscle groups, it is not practical to attach free weights to the body in order to effect those muscle groups. Furthermore, many muscle groups in the body require a significant amount of resistance to efficiently condition those muscle groups. In order to provide such resistance, a large mass of free weights would have to be used, wherein the weights would be large, bulky, hard to adjust in weight and potentially dangerous should the weights fall or be dropped.

The prior art has addressed the problems associated with free weights by the development of exercise machines where resistance is applied to the body by a secondary mechanism rather than directly by the free weights. Such prior art exercise machines typically provide resistance to a person in one of two ways, those ways being the use of framed weights or the use of resistance elements such as springs, elastic members, pneumatic cylinders and the like. Prior art exercise machines that utilize framed weights typically have a number of weights that are safely contained within a larger machine. The machine has various handles, bars or the like, rather than the weights themselves, that are actually engaged by the person exercising. The handles, bars or the like engaged by the person exercising are mechanically interconnected to the framed weights in some manner. This keeps the person exercising away from the moving weights, thereby providing a device that is safer and more versatile than free weights. As such, as a person manipulates the various handles, bars and the like, the framed weights provide resistance to such manipulations. The amount of resistance provided in such an exercise device is controlled by varying the number of framed weights that are actually moved when the various handles, bars and the like are moved. Such a prior art exercise device is exemplified by U.S. Pat. No. 4,478,411 to Baldwin, entitled APPARATUS AND METHOD FOR EXERCISING THE ABDUCTOR OR ADDUCTOR MUSCLES.

A common problem with framed weight exercise machines is that because of the mass of the weights, the frame to support the weights and the mechanical mechanisms to move the weights, such devices are typically very large, difficult to adjust to an individual's size and needs, are very expensive and are difficult to move from place to place.

In an attempt to reduce the size, cost and complexity of framed weight exercise devices, the prior art has seen the development of exercise devices that utilize resistance elements in place of framed weights. The resistance elements commonly used include pneumatic and hydraulic cylinders, springs, elastic members, frictional couplings, electromagnetic devices and the like. In such exercise devices, the degree of resistance provided by the resistance element is controlled by the number of the resistance elements used, the location of the resistance elements and/or the intensity of a secondary force, i.e. friction, electromagnetism or the like. For example, many prior art exercise devices use elastic members that join parts within the device. The elastic members resist the movement of the parts away from one another and provide the needed resistance to condition muscles. To increase or decrease resistance, the number of elastic members or the size of elastic members is changed. In other exercise devices that use springs, hydraulic cylinders or pneumatic cylinders, it is commonly the position of the resistance element that controls the resistance provided by that resistor element. As a result, many such exercise devices include some mechanism that allows for the positional adjustment of the resistance elements relative the moving elements of the exercise device. For an example of such an exercise device, see the low-impact climber exercise device, model 725e, sold commercially by PRECORE® U.S.A. The PRECORE® climbing machine provides resistance through the use of pneumatic cylinders. The angle of the pneumatic cylinders can be adjusted between the moving step and the stationary base, thereby varying the resistance provided by the cylinders.

In prior art exercise devices that use secondary forces such as friction or electromagnetism to create resistance, the secondary force is simply increased or decreased to adjust the resistance provided by the exercise device. For an example of such a device, see U.S. Pat. No. 4,720,099 entitled EXERCISE MACHINE. See specifically FIG. 17 for a leg abductor exercising machine embodiment.

Although prior art exercise machines that use resistance elements are generally less expensive and smaller than framed weight exercise machines, resistance element exercise machines are still typically bulky and large because they are commonly required to support the body of the person exercising. This generalization is even more prevalent in exercise machines designed to exercise multiple muscle groups. Since the exercise device is designed to exercise different parts of a person's body, the exercise device commonly supports a person's body in the proper position to conduct the different exercises. Typically, exercise devices that are designed to exercise different muscle groups include separate resistance elements for each of the muscle groups and include different engagement surfaces for different parts of the body, for instance the arms and legs. The use of different resistance elements and different engagement surfaces adds significantly to the cost, size and bulk of the exercise device.

Exercise machines that are capable of exercising multiple muscle groups commonly concentrate on one section of a person's body. For example, there are prior art exercising machines that exercise the various muscle groups in just the upper body, the legs or the stomach/-mid-torso region. There are, however, very complicated exercise machines that exercise muscle groups across the entire body. However, such exercise machines tend to concentrate only on a half dozen or so of the major muscle groups. Such exercise devices are often very complicated and require complex routine maintenance. These prior art exercise devices also are very expensive and usually come in only one standard size. As a result, all people regardless of their stature are required to utilize a single sized device. This leads to the prior art exercise devices being too large for some people, too small for others and generally an uncomfortable compromise for most. Furthermore, prior art exercise machines tend to be designed to be neutral with regard to the gender of the person intended to use the machine. There are of course exercise devices for pregnant women and devices traditionally used mainly by women such as devices designed to tone thigh muscles. However, these exercise devices are conventionally single exercise devices. Very few exercise devices provide exercises for multiple muscle groups wherein the multiple muscle groups are chosen to be gender specific. For instance, many women, because of their physiology, have a higher risk than men for developing osteoporosis. Similarly, women tend to gain weight in the hips and thighs as opposed to men who tend to gain weight around the waistline. There therefore exists a need in the field of exercise devices to provide a piece of exercise equipment that is concerned with the health requirements and concerns of a specific gender and provides multiple exercises that address these health concerns.

It is therefore an object of the present invention to provide an exercise device that provides multiple exercises that are specific to the health concerns commonly associated with a specific gender.

It is a further object of the present invention to provide such an exercise device that is compact, lightweight and inexpensive to manufacture.

It is yet another object of the present invention to provide such an exercise device that can be custom assembled to a person's body size and requires little, if any, maintenance to maintain the operation of the exercise device.

SUMMARY OF THE INVENTION

The present invention is an exercise device that enables a person to exercise the abductor muscles of the legs, the postural muscles and the muscles of the upper arms. In a preferred embodiment, the present invention exercise device includes a base structure adapted to rest upon a flat surface, such as a floor. The base structure has a flat horizontal surface supported a short distance above the floor and an inclined surface that is coupled to one edge of the horizontal surface, providing a smooth transition between the horizontal surface and the floor.

Two elongated members, each having an upper end and a lower end, are joined to the horizontal surface of the base structure. The lower end of each elongated member is pivotably coupled to the horizontal surface in a manner that enables each of the elongated members to be pivotably moved about its lower end in a direction generally away from the other elongated member. The pivotable movement of each of the elongated members is resisted by the presence of at least one resistance element that extends between each elongated member and the base structure. The presence of the resistance elements biases each elongated member into a set position that is generally perpendicular to the horizontal surface of the base structure. As a result, each of the elongated members can be pivotably moved away from each other by applying a force to an elongated member that is greater than the resistance provided by the resistance element. Once the force is removed, the resistance element returns the elongated member to its nominal vertical position.

In a preferred embodiment, the resistance to movement provided by the resistance elements can be selectively adjusted by adjusting the angle of inclination of the resistance elements between the elongated members and the base structure. Similarly, the distance between the two elongated members is also selectively adjustable by adjusting the points at which the lower ends of each of the elongated members pivotably engage the base structure. As a result, both the resistance provided in and the size of the present invention exercise device can be adjusted to match the needs of a particular individual.

Handles extend above the upper end of each of the elongated members. The handles are joined to the elongated members by a second set of resistance elements that resist the movement of the handles above their nominally set position. As such, the handles can be lifted above the upper ends of the elongated members provided the lifting force applied is greater than the resistive force of the resistance elements. Once the lifting force is removed, the handles return to their set position atop the elongated members. Furthermore, the resistance provided to the handles by the resistance elements can be selectively adjusted by adjusting the points at which the resistance elements engage the elongated members.

The combined exercises that can be performed by the below described present invention apparatus, enable a person to exercise and tone the leg abductor muscles, the postural muscles and the upper arm muscles in a cost effective and ergonomically correct manner.

BRIEF DESCRIPTION OF THE DRAWINGS

For a better understanding of the present invention, reference is made to the following description of an exemplary embodiment thereof, considered in conjunction with the accompanying drawings, in which:

FIG. 3 shows a perspective view of one preferred embodiment of the present invention in conjunction with a person to illustrate exercises that can be conducted for the abductor muscle groups of the legs;

FIG. 4 shows a perspective view of the present invention exercise device in conjunction with a person to illustrate alternate exercises that can be conducted for the postural muscle groups.

DETAILED DESCRIPTION OF THE PRESENT INVENTION

Figure 1:
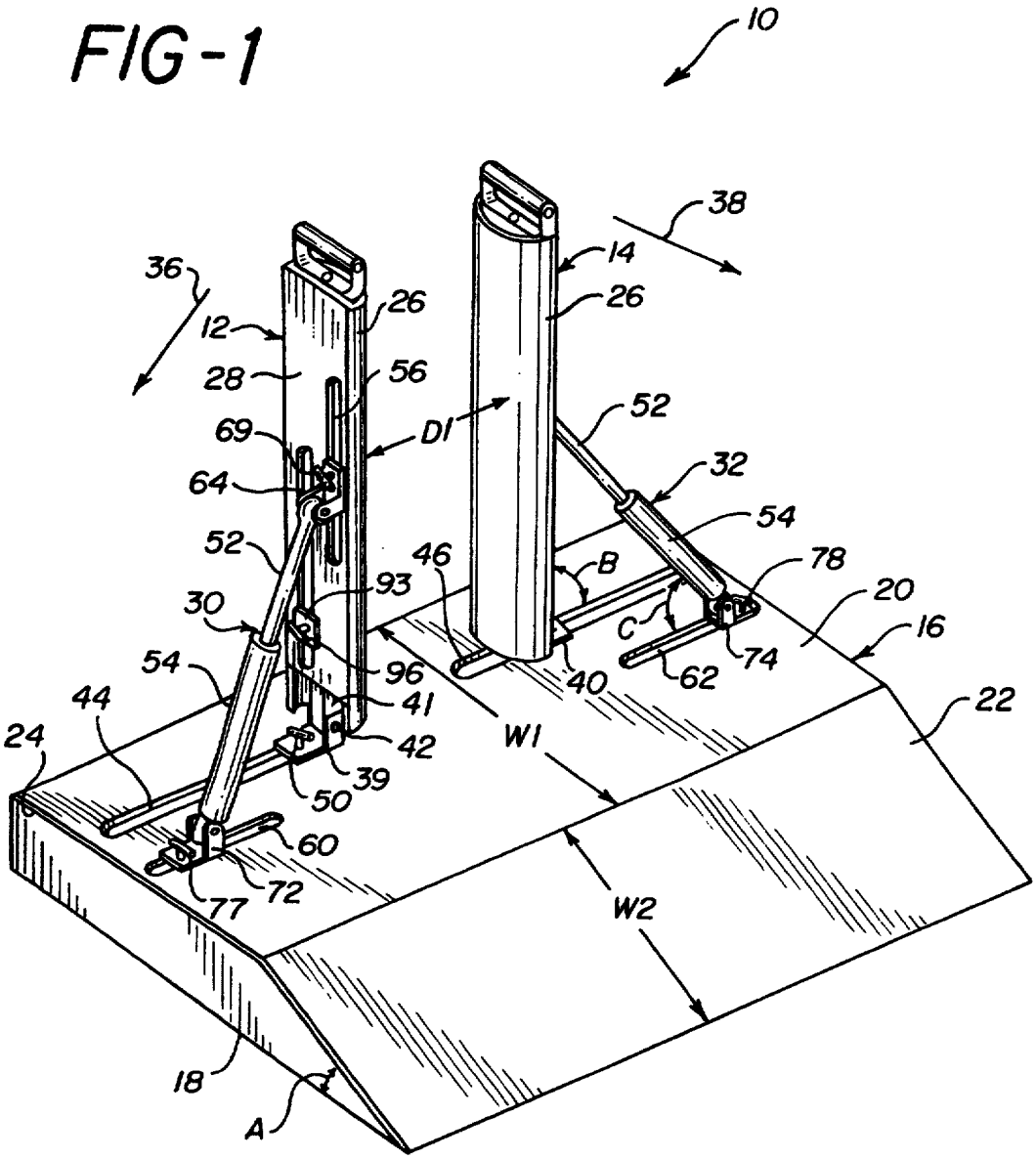
FIG. 1 shows a perspective view of one preferred embodiment of the present invention.
Figure 2:
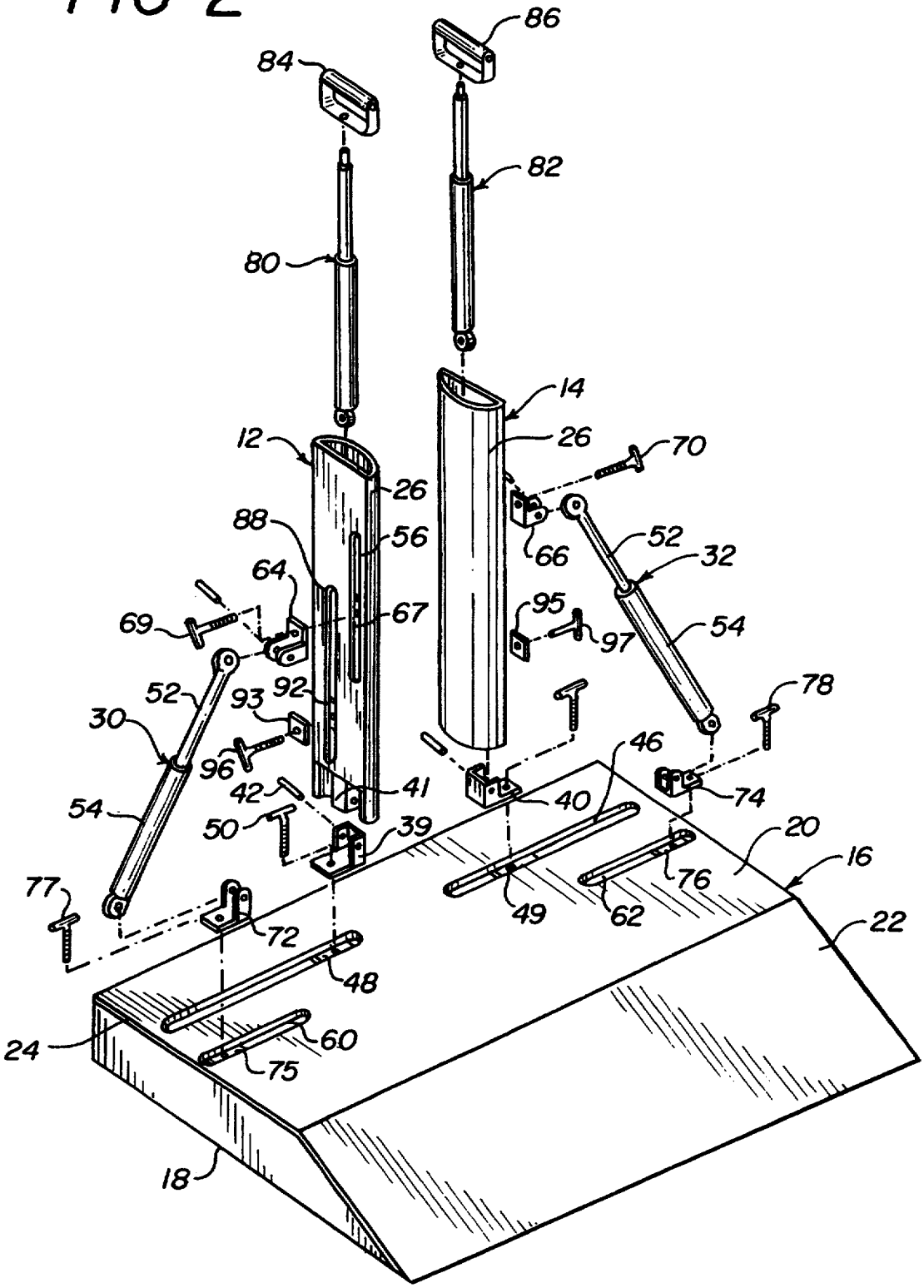
FIG. 2 shows an exploded perspective view of the embodiment of the present invention exercise device shown in FIG. 1 to facilitate consideration and discussion.

Referring to FIGS. 1 and 2, a first preferred embodiment of the present invention exercise device 10 is shown having two vertical engagement members 12, 14 that extend upwardly from a base support 16. The base support 16 has a flat bottom surface 18 that lays flush against the floor. The upper surface of the base support 16 is not flat, but is rather divided into two distinct surfaces. A first horizontal surface 20 lays in a horizontal plane parallel to the flat bottom surface 18. An angled surface 22 extends from one edge of the horizontal surface 20 to the flat bottom surface 18 at an angle of inclination A. For purposes that will be later explained, both the horizontal surface 20 and the angled surface 22 should have widths W1, W2, respectively that provide enough room for a person to comfortably stand or sit on either the horizontal surface 20 or the angled surface 22.

Furthermore, in the preferred embodiment, both the horizontal surface 20 and the angled surface 22 of the base support 16 are padded. The base support 16 is preferably made of a high strength, low weight material such as molded plastic, aluminum or the like. The padding applied to the base support 16 may come in the form of padded material 24 adhesively applied to the horizontal surface 20 and angled surface 22. The padded material 24 cushions these surfaces for comfort; yet the padding material 24 used is of a type that is firm and highly resistant to wear so as to withstand repeated wear from a person's shoes.

The two vertical engagement members 12, 14 that extend upwardly from the base support 16 are identical in construction. Each of the engagement members 12, 14 is an elongated structure having a contact surface 26 and an opposite back surface 28. In the shown embodiment, the contact surface 26 of each of the engagement members 12, 14 is curved into a semi-cylindrical shape. The contact surface 26 extends substantially across the entire length of each engagement member 12, 14 from its upper end to its point of interconnection with the base support 16. Although a semi-cylindrical contact surface 26 is shown, it should be understood that the contact surface 26 can be flat or can be any other shape that can be comfortably engaged by a user. In the preferred embodiment, each of the contact surfaces 26 is also padded so as to be comfortable to engage with various body parts, as will be later explained.

The back surface 28 of each of the vertical engagement members 12, 14 is flat in the shown embodiment. As will be later explained, a flat back surface 28 facilitates the interconnection of each of the vertical engagement members 12, 14 to resistance elements 30, 32, respectively. However, it will be understood that the use of a flat back surface 28 is merely exemplary and any other configuration can be used. For instance, each of the vertical engagement members 12, 14 may be cylindrical in shape, having a curved contact surface 26 and a curved back surface 28. As a result, each of the resistance elements 30, 32 would engage the curved back surface.

Each of the engagement members 12, 14 is attached to the horizontal surface 20 of the base support 16. For purposes which will be later explained, the engagement members 12, 14 are positioned a distance D1 away from each other in an orientation so that the contact surface 26 of the first engagement member 12 faces the contact surface 26 of the second engagement member 14. The engagement members 12, 14 are joined to the below lying horizontal surface 20 of the base support 16 in such a manner that enables the engagement members 12, 14 to pivotably move away from each other. In other words, each of the engagement members 12, 14 is nominally positioned at a perpendicular to the horizontal surface 20 of the base support 16. As such, the angle B between the horizontal surface 20 and each of the engagement members 12, 14 is nominally ninety degrees, that is the engagement members 12, 14 are perpendicular to the horizontal surface 20. The interconnection between the engagement members 12, 14 and the horizontal surface 20 of the base support 16 enables the engagement members 12, 14 to pivotably rotate from the point of interconnection in the directions of arrows 36, 38. As a result, the engagement members 12, 14 can be selectively positioned in relation to the horizontal surface 20 so that the angle B between the engagement members 12, 14 and the horizontal surface 20 is any acute angle. Such an interconnection between the engagement members 12, 14 and the base support 16 can be made with any hinged connector, ball and socket joint, universal joint, flexible spring joint or a pivot interconnection as is shown. In the shown embodiment, the bottom ends 41, 43 of each of the engagement members 12, 14 pivotably interconnects with a bracket 39, 40 via pivot pins 42. The presence of the pivot pins 42 enables the engagement members 12, 14 to move relative the brackets 39, 40. The shapes of the brackets 39, 40 may also prevent the engagement members 12, 14 from being accidentally moved in the wrong direction such as beyond their normal vertical orientations.

In a preferred embodiment, the distance D1 between each of the engagement members 12, 14 is selectively adjustable by the person using the exercise device 10. Consequently, a person can place the engagement members 12, 14 as close together or as far apart as is desired. To facilitate the adjustable positioning of the engagement members 12, 14 relative each other, many well known systems can be used. For instance, a plurality of threaded holes can be positioned along the horizontal surface 20 of the base support 16. The brackets 39, 40 may have bolt holes formed through them. As such, the brackets 39, 40 can be selectively bolted to the threaded holes at any position along the horizontal surface 20. Similarly, a plurality of holes may be disposed along the horizontal surface 20 of the support base 16. The brackets 39, 40 may have pegs or like structures extending from them that snap-fit into the various holes and interconnect the brackets 39, 40 to the horizontal surface 20 at desired locations. In the shown embodiment, two slots 44, 46 are formed along the horizontal surface 20 of the base support 16. A threaded clamp structure 48, 49 is disposed on the side of the slots 44, 46 opposite each of the brackets 39, 40. As the brackets 39, 40 are tightened against the threaded clamp structure 48, 49 the brackets 39, 40 become clamped to the horizontal surface 20. The tension between the brackets 39, 40 and the threaded clamp structures 48, 49 are controlled by the manipulation of tightening bolts 50, 51 that extend through each bracket 39, 40. The bolts 50, 51 each have a head that is easily grabbed and manipulated, thereby allowing the bolts 50, 51 to be tightened and loosened by hand. Each bracket 39, 40 is moved along the slots 44, 46 until a desired position is obtained. When the brackets 39, 40 are positioned as desired, the tightening bolts 50, 51 are rotated and the threaded clamp structures 48, 49 are pulled tightly toward the brackets 39, 40, thereby selectively locking the brackets 39, 40 into a set position on the horizontal surface 20 of the base support 16. Since the brackets 39, 40 support the bottom ends 41, 43 of the engagement members 12, 14, the position of the brackets 39, 40 determines the distance D1 between the engagement members 12, 14.

A resistance element 30, 32 is attached to each of the engagement members 12, 14. The resistance elements 30, 32 are positioned in relation to the engagement members 12, 14 so as to resist the pivotable movement of each of the engagement members 12, 14 in the directions of the arrows 36, 38, respectively. As such, even though the pivotable interconnection between the engagement members 12, 14 and the brackets 39, 40 allow the engagement members 12, 14 to pivotably move in directions of arrows 36, 38, the presence of the resistance elements 30, 32 provides a predetermined bias against such movements. The resistance elements 30, 32 are compressed when the engagement members 12, 14 pivotably move in the directions of the arrows 36, 38. As a result, it will be understood that the resistance elements 30, 32 can be any structure, such as a spring, pneumatic cylinder or hydraulic cylinder that provides a given resistance to a compressive force.

In the shown preferred embodiment, cylinders are used as the resistance elements 30, 32. These cylinders can be air filled or liquid filled, or they can contain an internal spring member that prevents the pushrod 52 of the cylinder from advancing into the cylinder body 54. After a compression force is removed, the cylinders are of the type to allow the pushrod 52 of the cylinder to return to its original position relative the cylinder body 54. Such cylinders are well known in the art and are readily commercially available.

Vertical adjustment slots 56 are disposed on the back surface 28 of each of the engagement members 12, 14. Similarly, horizontal adjustment slots 60, 62 are disposed on the horizontal surface 20 of the base support 16. A first set of brackets 64, 66 are joined to the vertical adjustment slots 56 via threaded clamp structures 67 that selectively clamp the brackets 64, 66 to the vertical adjustment slots 56. The brackets are tightened to the threaded clamp structures by adjustment bolts 69, 70. The bolts 69, 70 have heads that can be easily manipulated by hand. As such, the first set of brackets 64, 66 can be selectively locked into position at any point along the length of the vertical adjustment slots 56 by moving the brackets 64, 66 to the desired position and tightening the adjustment bolts 69, 70 by hand. Similarly, a second set of brackets 72, 74 are joined to the horizontal adjustment slots 60, 62 via threaded clamp structures 75, 76 that selectively clamp the brackets 72, 74 into a set position along the horizontal adjustment slots 60, 62. The brackets 72, 74 are tightened and loosened to the threaded clamp structures 75, 76 by adjustment bolts 77, 78. As such, the second set of brackets 72, 74 can be selectively locked into position at any point along the length of the horizontal adjustment slots 60, 62, by moving the brackets 72, 74 into the desired position and tightening the adjustment bolts 77, 78 by hand.

The resistance elements 30, 32 extend between the brackets 64, 66 on the vertical adjustment slots 56 to the brackets 72, 74 on the horizontal adjustment slots 60, 62. At both points, the resistance elements 30, 32 are joined to the various brackets by a pivot interconnection. As the resistance elements 30, 32 extend between vertical adjustment slots 56 and the horizontal adjustment slots 60, 62, the resistance elements 30, 32 possess an angle of inclination C with respect to the horizontal surface 20 of the base support 16. By selectively adjusting the position of the brackets 64, 66 in the vertical adjustment slots 56 and the position of the brackets 72, 74 in the horizontal adjustment slots 60, 62, the angle of inclination C of the resistance elements 30, 32 can be selectively altered while maintaining the engagement members 12, 14 at a perpendicular to the horizontal surface 20 of the base support 16. It will be understood that by selectively altering the angle of inclination C for the resistance elements 30, 32, the degree of resistance those elements provide against the pivotable movement of the engagement members 12, 14 can be selectively altered to a desired degree.

The use of brackets, clamp structures and adjustment slots to control the angle of inclination C of the resistance elements 30, 32 is merely exemplary. Any other known means for adjusting the angle of inclination C or just providing one set angle of inclination C are also intended to be covered by the scope of this invention.

Referring to FIG. 3 in conjunction with FIGS. 1 and 2, it can be seen that the present invention exercise device 10 can be used to exercise the abductor muscles in the legs and hips, including the psoas muscles, gluteus maximus, gluteus medius and gluteus minimus. To exercise these muscles, the person exercising must first set the distance D1 between the engagement members 12, 14 to a distance wide enough to let the hips of the person fit comfortably between the engagement members 12, 14. The person exercising then adjusts the angle of inclination C of the various resistance elements 30, 32 so as to provide a given resistance to the pivotable movement of the resistance elements 30, 32. Once the exercise device 10 is properly positioned and adjusted, the person exercising lays across the base support 16 so that the person's torso is flat on the floor, their lower back being supported by the angled surface 22 of the base support 16 and their legs extending between the engagement members 12, 14.

The angle of inclination A of the angled surface 22 of the base support 16 provides a transition between the floor level and the level of the horizontal surface 20. By positioning one's lower back over the angled surface 22, a person's back is fully supported in a position that is both safe and comfortable for the back. Additionally, by providing a working position for the person exercising on the floor, the present invention exercise device 10 does not require the large bulky frame typically needed in prior art exercise devices to support a person's body off the ground.

Once a person's legs are positioned between the engagement members 12, 14, several exercises can be performed. In the shown embodiment, the middle of the person's thighs abut against and engage the contact surfaces 26 of the engagement members 12, 14. By a person moving their thighs against the engagement members 12, 14, the engagement members 12, 14 begin to pivotably rotate in the directions of arrows 36, 38. This movement is resisted by the resistance elements 30, 32, thereby providing work to the abductor muscles. Once the person exercising relaxes his or her leg abductor muscles, the engagement members 12, 14 return to their original vertical positions as so biased by the resistance elements 30, 32. The presence of padding on the contact surface 26 and the base structure 16 provides for the comfort of the person conducting the exercises.

To exercise other leg abductor muscles, the person exercising varies the point of engagement between the contact surfaces 26 of the engagement members 12, 14 and the person's legs. For instance, a person may position themselves to engage the contact surfaces with their upper thighs, mid thighs, knees, calves or ankles. By working against the bias of the engagement members 12, 14 with these parts of the body, different muscles are worked.

Referring back to FIGS. 1 and 2, it can be seen that secondary resistance elements 80, 82 are disposed near the top ends of engagement members 12, 14. Each of these secondary resistance elements 80, 82 terminates at one end with a handle 84, 86 that extends above the engagement members 12, 14. The secondary resistance elements 80, 82 can be any device or structure that provides a predetermined resistance to a tensile force. For instance, the secondary resistance elements 80, 82 may be springs, elastic members, weights, pneumatic cylinders, hydraulic cylinders or simply friction elements. In the shown embodiment, however, cylinders are used wherein one end of the cylinder is pivotably connected to the engagement members 12, 14 and the opposite end of the cylinder is pivotably coupled to a handle 84, 86.

In the shown embodiment, the degree of resistance provided by the secondary resistance elements 80, 82 is a function of the position of those secondary resistance elements 80, 82 relative the engagement members 12, 14. However, any other known means for adjusting resistance may also be utilized. A vertical slot 88 is disposed within the back surface 28 of each of the engagement members 12, 14. A bracket 92 is slidably adjustable within each of these vertical slots 88, via a threaded clamping structure 93, 95 and an adjustment bolt 96, 97 that tightens and loosens the brackets 92 to the threaded clamping structures 93, 95. As a result, the brackets 92, can be locked into position at any point along the length of the vertical slots 88. The secondary resistance elements 80, 82 attach at one end to the brackets 92. Consequently, the position where the secondary resistance elements 80, 82 join to the engagement members 12, 14 can be selectively altered, resulting in a change in resistance to the movement of the handles 84, 86 provided by the secondary resistance elements 80, 82.

Referring to FIG. 4 in conjunction with FIGS. 1 and 2, it can be seen that the present invention exercise device 10 can be used to exercise the postural muscles in the upper back, including the trapezius, rhomboid, supraspinatus, teres minor, latissimus dorsi and deltoids. To exercise these muscles, the person exercising must first set the distance D1 between the engagement members 12, 14 to a distance wide enough to let the person exercising to stand between the engagement members 12, 14. The person exercising then adjusts the resistance of the secondary resistance elements 80, 82 and the angle of inclination C for the lower resistance elements 30, 32. Once the exercise device 10 is properly positioned and adjusted, the person exercising stands on the angled surface 22 of the base support 16 facing the engagement members 12, 14. By standing on the angled surface 22, stress is relieved in the person's lower back, thereby reducing the chance of injury to the lower back during the postural exercises.

To perform the postural exercises, the person exercising grabs the handles 84, 86 that extend above the engagement members 12, 14. The person exercising then lifts the handles 84, 86 upwardly at various distances from the body. The secondary resistance elements 80, 82 resist the upward movement of the handles 84, 86, thereby providing exercise to the postural muscles. Furthermore, as a person lifts his or her arms, the movement is not perfectly vertical. Inevitably the arm either rotates towards or away from the body. Such horizontal components to the exercises are resisted, but not prevented, by the resistance elements 30, 32 that interact with the lateral movements of the engagement members 12, 14. As a result, the engagement members 12, 14 move back and forth with the arm, providing an exercise that ergonomically corrects for the anatomical features of the person exercising.

Figure 5:
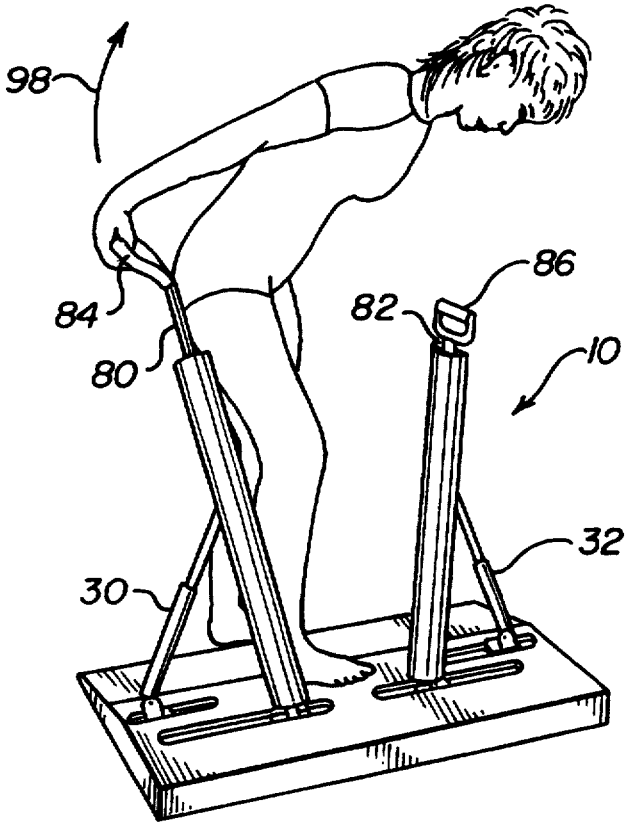
FIG. 5 shows a perspective view of the present invention exercise device in conjunction with a person to illustrate alternate exercises that can be conducted for muscles in the upper arm.

Referring to FIG. 5 in conjunction with FIGS. 1 and 2, it can be seen that the present invention exercise device 10 can be used to exercise the muscles in the upper arms including the deltoid muscles and tricep muscles. To exercise these muscle groups, the person holds one of the handles 84, 86 to the side of his or her body. With the arm fully extended, the arm is then rotated rearwardly in the direction of arrow 98. As the arm rotates, it pulls upwardly on the handle 84. The movement of the handle 84 is resisted by the secondary resistance element 80, thereby providing exercise to the upper arm. As the arm is rotated behind the body, the natural movement of the arm includes both vertical and horizontal components. The vertical components of the movement are resisted by the secondary resistance elements 80, 82. Similarly, the horizontal components of the movement are resisted, but not prevented, by the lower resistance elements 30, 32 that resist the lateral movements of the engagement members 12, 14. As a result, the engagement members 12, 14 pivot with the change in position of the person's arm, providing an exercise that is ergonomically correct for the anatomical features of the person exercising.

It will be understood that the embodiment described herein is merely exemplary and that a person skilled in the art may make many variations and modifications to the described embodiments utilizing functionally equivalent elements to those described. More specifically, it should be understood that any type of known resistance elements may be used in place and stead of the ones shown. Additionally, alternate shapes for many components can be substituted for the ones shown. Similarly, dimensions and proportions of interrelating parts can be selectively changed or features removed. All such variations and modifications are intended to be included within the scope of this invention as defined by the appended claims.

What is claimed is:

1. An exercise apparatus comprising:

a base structure that includes a generally horizontal surface;

a first elongated member pivotably coupled to said generally horizontal surface;

a second elongated member pivotably coupled to said generally horizontal surface, wherein said first elongated member and said second elongated member are coupled to said generally horizontal surface at points a predetermined distance apart along a first line, whereby said predetermined distance is wide enough to enable a person's legs to fit between said first elongated member and said second elongated member;

at least one first resistance element having a first end adjustably interconnected to said first elongated member and a second end adjustably interconnected to said base structure enabling the angle of inclination of said at least one first resistance element relative to the base structure to be selectively adjusted, said at least one first resistance element biasing said first elongated member into a first set orientation substantially perpendicular to said generally horizontal surface, said at least one resistance element resisting the pivotal movement of said first elongated member from said first set orientation in the general direction away from said second elongated member when a lateral force is applied to said first elongated member, whereby said at least one first resistance element automatically returns said first elongated member to said first set orientation upon the elimination of the lateral force;

at least one second resistance element having a first end adjustably interconnected to said second elongated member and a second end adjustably interconnected to said base structure enabling the angle of inclination of said at least one second resistance element relative to the base structure to be selectively adjusted, said at least one second resistance element biasing said second elongated member in a second set orientation substantially perpendicular to said generally horizontal surface, said at least one second resistance element resisting the pivotal movement of said second elongated member from said second set orientation in a direction generally away from said first elongated member when a lateral force is applied to said second elongated member, whereby said at least one second resistance element automatically returns said second elongated member to said second set orientation upon the elimination of the lateral force.

2. The apparatus according to claim 1, further including an adjustment means for adjusting said predetermined distance between said first elongated member and said second elongated member on said generally horizontal surface.

3. The apparatus according to claim 1, wherein said base structure includes a bottom surface, adapted to rest upon a level plane, and an inclined surface wherein said generally horizontal surface is supported a predetermined height above said bottom surface and said inclined surface extends between said generally horizontal surface and said bottom surface at a predetermined angle of inclination.

4. The apparatus according to claim 1, wherein said at least one first resistance element resists the pivotal movement of said first elongated member from said first set orientation with a first resistive force and said at least one second resistance element resists the pivotal movement of said second elongated member from said second set orientation with a second resistive force, said apparatus further including adjustment means for selectively adjusting said first resistive force and said second resistive force.

5. The apparatus according to claim 1, wherein said first elongated member terminates at a first upper end and said second elongated member terminates at a second upper end, said first elongated member including a first upper resistance element, wherein said first upper resistance element terminates at a first handle that extends beyond said first upper end of said first elongated member, and said second elongated member includes a second upper resistance element, wherein said second upper resistance element terminates at a second handle that extends beyond said second upper end of said second elongated member, whereby said first upper resistive element and said second upper resistance element respectively resist the movement of said first handle and said second handle away from said first elongated member and said second elongated member with a predetermined force.

6. The apparatus according to claim 5, further including a means for selectively adjusting said predetermined force provided to said first handle and said second handle by said first upper resistance element and said second upper resistance element, respectively.

7. The apparatus according to claim 1, wherein said first elongated member and said second elongated member both include an engagement surface that face generally toward one another and are adapted to be engaged by a person's legs.

8. The apparatus according to claim 1, wherein said engagement surface is curved into a generally semi-cylindrical shape.

9. The apparatus according to claim 1, wherein said at least one first resistance element is coupled to said generally horizontal surface at a first point on a second line and said at least one second resistance element is coupled to said generally horizontal surface at a second point on said second line, wherein said second line is parallel to, and a predetermined distance from, said first line.

10. The apparatus according to claim 3, wherein said bottom surface and said inclined surface are padded.

11. The apparatus according to claim 1, wherein said at least one first resistance element and said at least one second resistance element include a cylinder selected from a group consisting of pneumatic cylinders, hydraulic cylinders and spring cylinders.

12. An exercise apparatus for the leg abductor muscles, comprising:

a base structure positionable on the floor, wherein said base structure includes a horizontal plane supported a predetermined height above the floor and an inclined surface that extends from the floor to the horizontal plane at a predetermined angle of inclination;

a first and second elongated member, each being pivotably coupled to said horizontal plane a predetermined distance apart, whereby a person laying on said base structure in a supine position can position their legs between said first and second elongated members and apply a force with their legs that acts to separate said first and second elongated members;

a first cylinder coupled between said first elongated and said base structure, wherein said first cylinder acts to bias said first elongated member into a generally perpendicular orientation with respect to said horizontal plane, said first cylinder resisting the force applied to said first elongated member by a person's legs that acts to pivotably move said first elongated member out of said generally perpendicular orientation;

a second cylinder coupled between said second elongated member and said base structure, wherein said second cylinder acts to bias said second elongated member into a generally perpendicular orientation with respect to said horizontal plane, said second cylinder resisting the force applied to said second elongated member by a person's legs that acts to pivotably move said second elongated member out of said generally perpendicular orientation; and wherein said first elongated member and said second elongated member are coupled to said base structure at points on a first line and said first cylinder and said second cylinder are coupled to said base structure at points on a second line, wherein said second line is parallel to, and a predetermined distance from, said first line.

13. The apparatus according to claim 12, further including an adjustment means for adjusting said predetermined distance between said first elongated member and said second elongated member on said generally horizontal surface.

* * * * *